US006348108B1

(12) United States Patent
Yusa et al.

(10) Patent No.: US 6,348,108 B1
(45) Date of Patent: Feb. 19, 2002

(54) HIGH TOUGHNESS STEEL AND A METHOD FOR MANUFACTURING THE SAME

(75) Inventors: Satoru Yusa; Kaneaki Tsuzaki; Toshihiko Takahashi, all of Ibaraki (JP)

(73) Assignee: National Research Institute for Metals, Ibaraki (JP)

( * ) Notice: Subject to any disclaimer, the term of this patent is extended or adjusted under 35 U.S.C. 154(b) by 0 days.

(21) Appl. No.: 09/260,056

(22) Filed: Mar. 2, 1999

(30) Foreign Application Priority Data

Mar. 4, 1998 (JP) ..... 10-52554
Mar. 4, 1998 (JP) ..... 10-52555

(51) Int. Cl.[7] ..... C22C 38/04
(52) U.S. Cl. ..... 148/320; 148/328; 428/694.5 G
(58) Field of Search ..... 148/320, 328; 428/694.5 G

(56) References Cited

FOREIGN PATENT DOCUMENTS

JP 2247354 * 10/1990
JP 7300653 * 11/1995

* cited by examiner

*Primary Examiner*—Sikyin Ip
(74) *Attorney, Agent, or Firm*—Wenderoth, Lind & Ponack, L.L.P.

(57) ABSTRACT

Ups and downs having a cycle of not more than 5 $\mu$m and an amplitude of not less than 200 nm are formed in a part of not less than 70% per unit length of a prior-austenite grain boundary which is observed in a linear form when seen from a vertical plane by a series of steps of subjecting a steel in a state of austenite to a deformation in not less than 30% of a total area reduction rate at a temperature region which is lower than recrystallization temperature of austenite, and subsequently cooling a deformed steel without causing neither recrystallization nor phase transformation of a diffusion type.

2 Claims, 11 Drawing Sheets

*Fig. 6* (Photo)
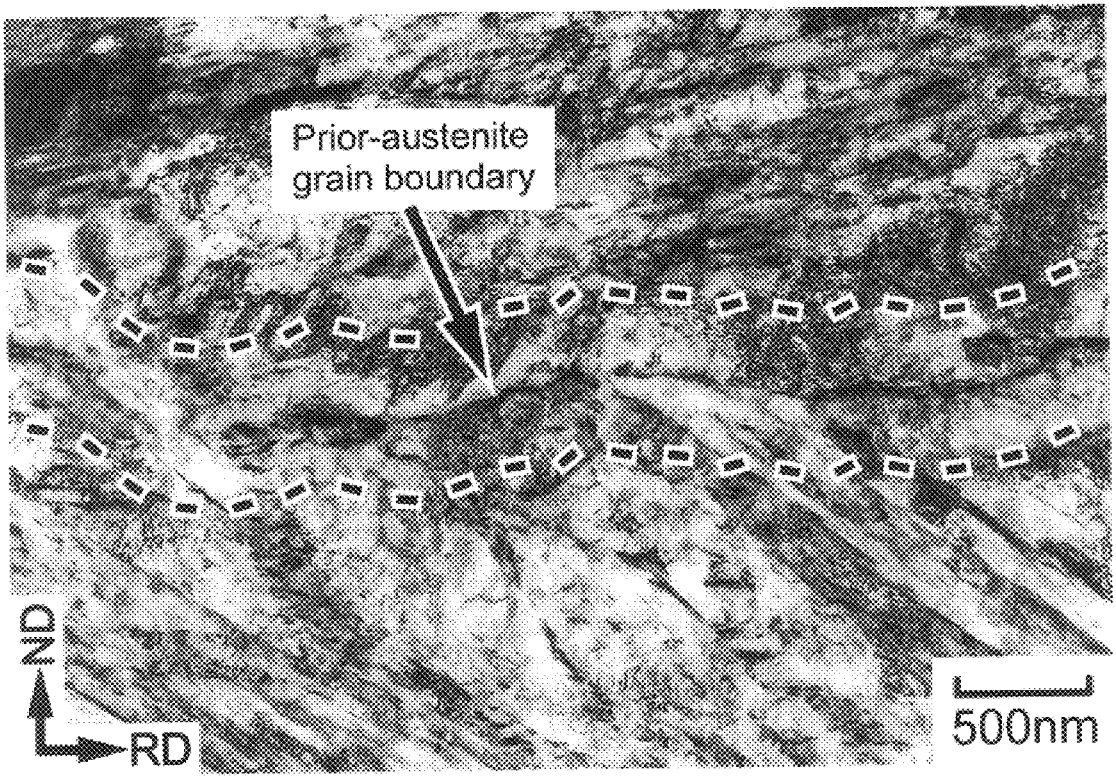

*Fig. 7* (Photo)
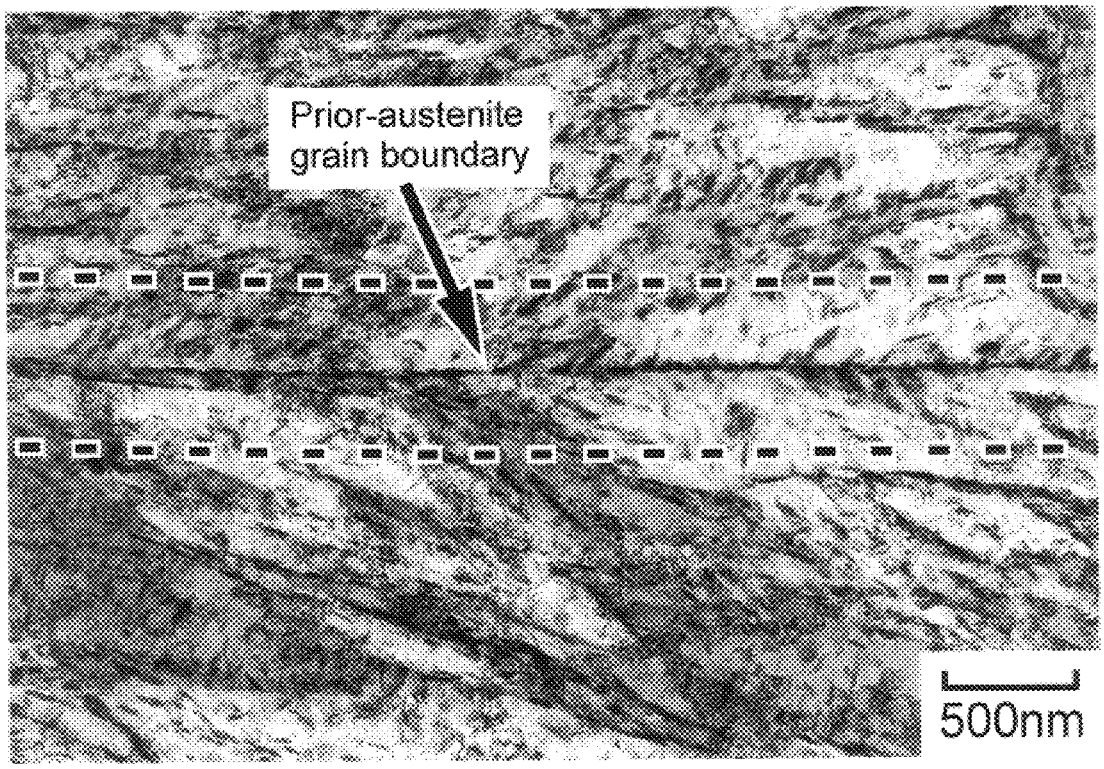

*Fig. 8* (Photo)
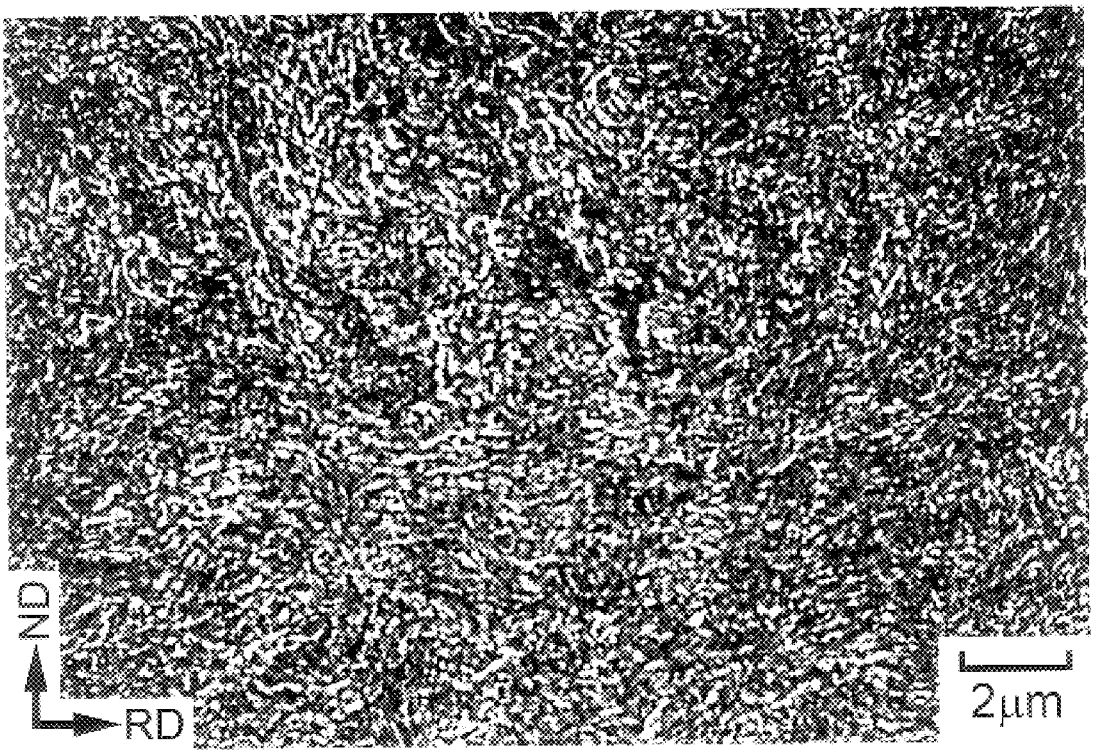

*Fig. 9* (Photo)
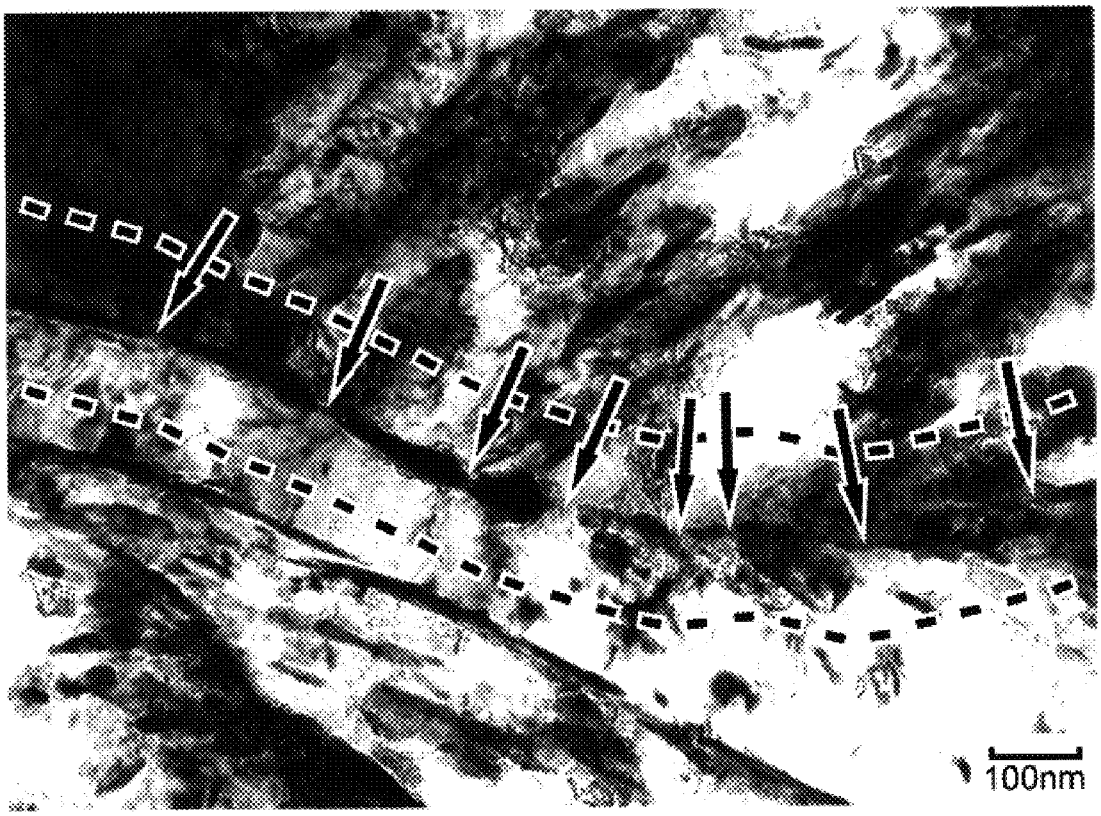

*Fig. 10* (Photo)
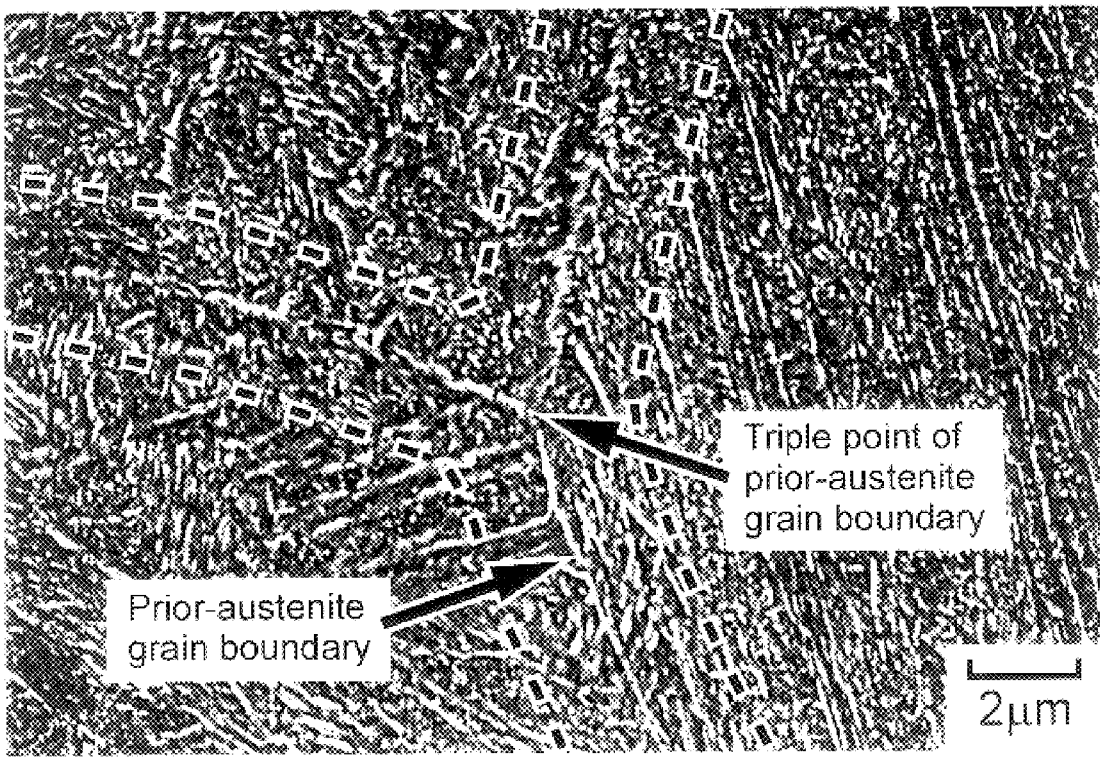

*Fig. 11* (Photo)
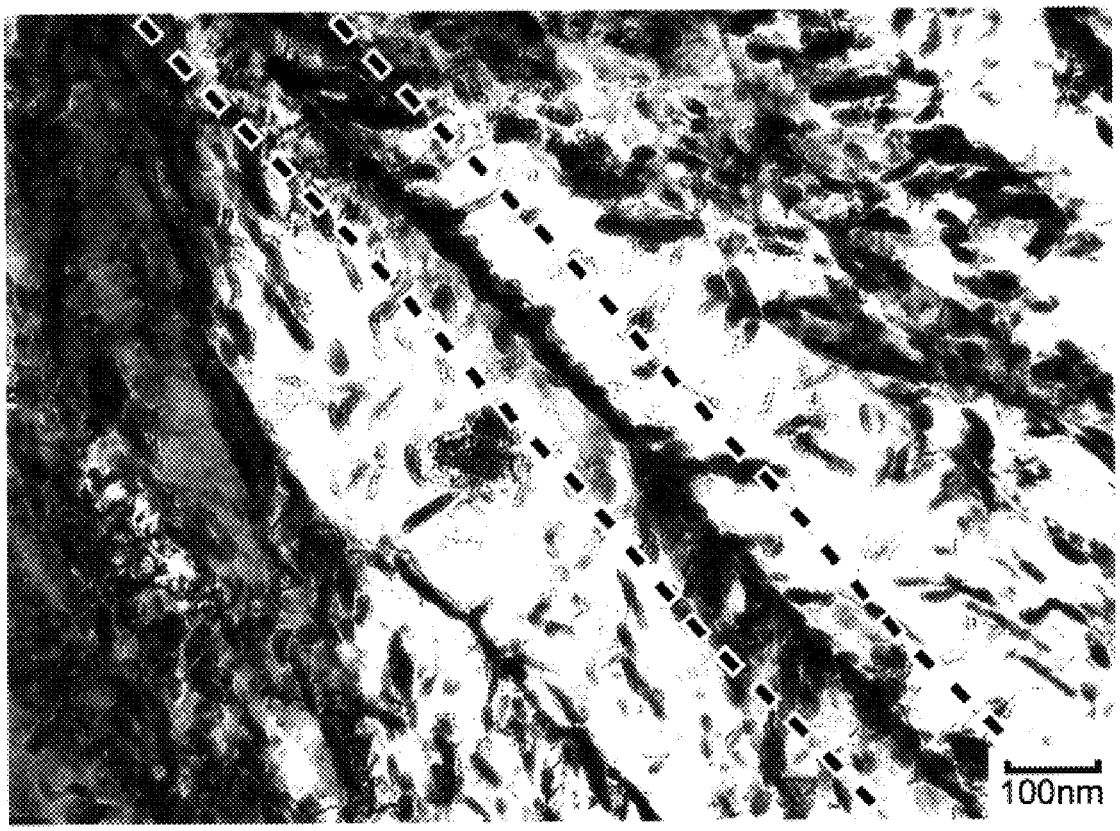

HIGH TOUGHNESS STEEL AND A METHOD FOR MANUFACTURING THE SAME

FIELD OF THE INVENTION

The invention of this application relates to a high toughness steel and to a method for manufacturing the same. More particularly, the invention of this application relates to a high toughness steel having an excellent toughness useful for a steel material used as steel for structural purposes such as steel bars, section steel, thin plates and thick plates and also relates to a method for manufacturing the same.

DESCRIPTION OF THE PRIOR ART

In a steel material which has been utilized as the steel for structural purposes, there is a problem that a prior-austenite grain boundary which is the weakest part or the inherent austenite grain boundary prior to conducting a mechanical process and a thermal treatment is broken whereby intergranular cracking is resulted and that a brittle fracture takes place.

For example, in the case of a tempered martensite steel, filmy carbides precipitate continuously in an a prior-austenite grain boundary and they restrict the plastic deformation near the grain boundary resulting in such a fracture in the grain boundary.

An object of the invention of this application is to suppress the fracture at a grain boundary caused by prior-austenite grain boundary and to offer a high toughness steel having an excellent toughness and a method for manufacturing the same.

This and other objects, features and advantages of the invention will become more apparent upon a reading of the following detailed specification and drawing, in which:

BRIEF DESCRIPTION OF THE DRAWINGS

FIG. 6 is a picture under a transmission electron microscope showing the grain boundary corresponding to the prior-austenite grain boundary of the high toughness and high strength steel obtained in Example 1.

FIG. 7 is a picture under a transmission electron microscope showing the grain boundary corresponding to the prior-austenite grain boundary of the high strength steel obtained in Comparative Example 1.

FIG. 8 is a picture under a scanning electron microscope showing a state of distribution of carbides of the tempered high toughness martensite steel obtained in Example 2.

FIG. 9 is a picture under a transmission electron microscope showing the precipitated grain boundary carbides corresponding to the prior-austenite grain boundary of the tempered high toughness martensite steel obtained in Example 2.

FIG. 10 is a picture under a scanning electron microscope showing a state of distribution of carbides of the tempered martensite steel obtained in Comparative Example 2.

FIG. 11 is a picture under a transmission electron microscope showing the boundary corresponding to the prior-austenite grain boundary of the tempered martenisite steel obtained in Comparative Example 2.

DETAILED DESCRIPTION OF THE INVENTION

The invention of this application offers the following two kinds of steel which is a high toughness steel. Thus, one is a high toughness and high strength steel while another is a tempered high toughness martensite steel.

Thus, the invention of this application offers a high toughness and high strength steel which has a structure in which a part of not less than 70% per unit length of the prior-austenite grain boundary observed as a linear state when seen from a vertical plane has ups and down with a cycle of not more than 5 $\mu$m and an amplitude of not less than 200 nm.

The invention of this application further offers a tempered high toughness martensite steel having a structure in which length of a part where carbide exist therein is not more than 80% of total length of an prior-austenite grain boundary observed in a linear state seen from a vertical plane and said prior-austenite grain boundary has ups and downs with a cycle of not more than 5 $\mu$m and an amplitude of not less than 200 nm.

The invention of this application furthermore offers a method for manufacturing a high toughness and high strength steel comprising the steps of subjecting a steel in a state of austenite to a deformation in not less than 30% of a total area reduction rate at a temperature region which is lower than recrystallization temperature of austenite, and subsequently cooling a deformed steel without causing neither recrystallization nor phase transformation of a diffusion type.

With regard to the above-mentioned high toughness and high strength martensite steel, the invention of this application offers a method for manufacturing a high toughness martensite steel comprising the steps of subjecting a steel in a state of austenite to a deformation in not less than 30% of a total area reduction rate at a temperature region which is lower than recrystallization temperature of austenite, cooling a deformed steel to change a texture of the steel to martensite, subsequently heating the steel at a temperature range of 300–500° C. with a heating rate of not less than 100° C./second, keeping the temperature range for 10–30 seconds, and then rapidly cooling the steel.

High Toughness and High Strength Steel and a Method for Manufacturing the Same

Figure 1:
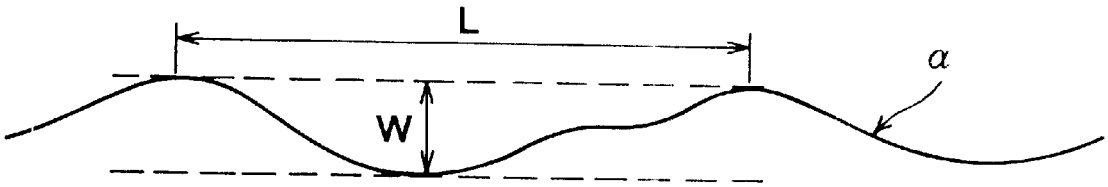
FIG. 1 is a brief view in a schematic manner of a grain boundary corresponding to the prior-austenite grain boundary of the high toughness and high strength steel in accordance with the invention of this application.

In the conventional and common high strength steel, the austenite grain boundary prior to certain process (hereinafter, referred to as "prior-austenite grain boundary") is linear while, in the high toughness and high strength steel according to the invention of this application, there are finely wavy ups and downs with a cycle (L) of not more than 5 $\mu$m and an amplitude (W) of not less than 200 nm in a part of not less than 70% per unit length of the prior-austenite grain boundary (a) which is observed in a linear state when seen from a vertical plane as shown in FIG. 1.

As a result of projections from a flat surface due to such ups and downs, the grain boundary area increases. As mentioned already, fracture of a grain boundary is apt to take place in the prior-austenite grain boundary. However, with an increase of the area, energy which is required for a grain boundary fracture can be increased and, in addition, a geometrical burden can be formed against the brittle cracking extending at the resistance prior-austenite grain boundary. As a result thereof, an improvement in toughness is achieved.

The increasing rate of the grain boundary area is dependent upon the radius of curvature and the existing rate of the ups and downs. When the grain boundary is observed on a cross section which is vertical thereto, radius of curvature can be expressed by a variation cycle (L) and an amplitude (W) of the grain boundary in a form of curves. Therefore, in accordance with the fact that the minimum value of the grain size of austenite is 10 $\mu$m, a cycle (L) of not less than 5 $\mu$m is necessary for transformation for an increase in the grain boundary area as mentioned above and, further, when a geometric similarity is taken into consideration, an amplitude (W) of not less than 200 nm is necessary.

When the cycle (L) is more than 5 $\mu$m, a substantial improvement in toughness can be hardly expected in the case of either the amplitude (W) is less than 200 nm or the existing rate of ups and down is not more than 70%.

Incidentally, it is easy to identify the prior-austenite grain boundary in steel. For example, in an observation under a common optical microscope or a scanning electron microscope, said boundary can be easily identified by means of an etching where an etching solution which preferentially corrodes the prior-austenite grain boundary is used On the other hand, in the case of observation under a transmission electron microscope, the prior-austenite grain boundary is clearly different from other texture boundaries such as block boundary and packet boundary of martensite and, accordingly, the identification is easy.

The high toughness and high strength steel of the invention of this application having such a characteristic prior-austenite grain boundary can be manufactured by subjecting the steel in a state of austenite to a deformation resulting in a total area reduction of not less than 30% at the temperature range which is lower than the temperature for recrystallization of austenite followed by subjecting to a cooling causing neither recrystallization nor phase transformation of a diffused type.

The technical elements which are characteristic to this manufacturing method are the following two, i.e. i) a deformation within an austenite region and ii) cooling which causes neither recrystallization nor phase transformation of a diffusion type.

i) Deformation in an Austenite Region

Figure 2:
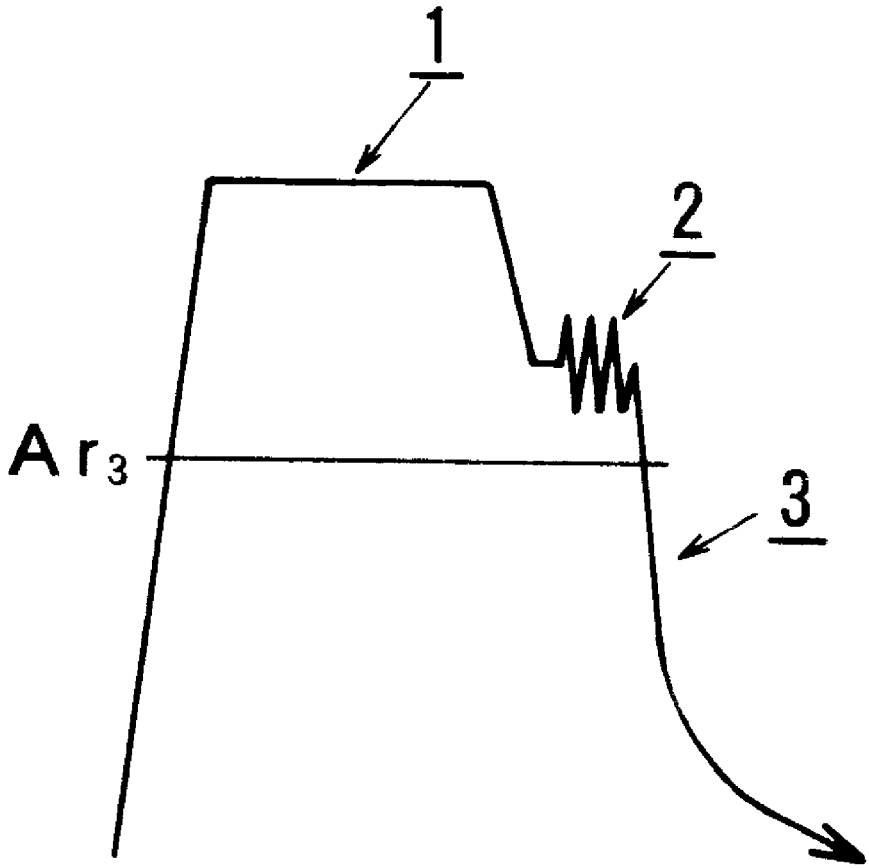
FIG. 2 is a process chart which briefly shows the method for the manufacture of the high toughness and high strength steel of the invention of this application.

As shown in FIG. 2, steel is completely made into austenite (1) and, after that, a deformation (2) resulting in a total area reduction rate of not less than 30% at a temperature region which is lower than the temperature for recrystallization of austenite is carried out. As a result of this deformation, a shear slip which is homogeneous macroscopically but non-homogeneous microscopically is formed in a crystal grains of austenite and the above-mentioned ups and down in small waves are introduced into not less than 70% of the area of the austenite grain boundary.

Figure 3:
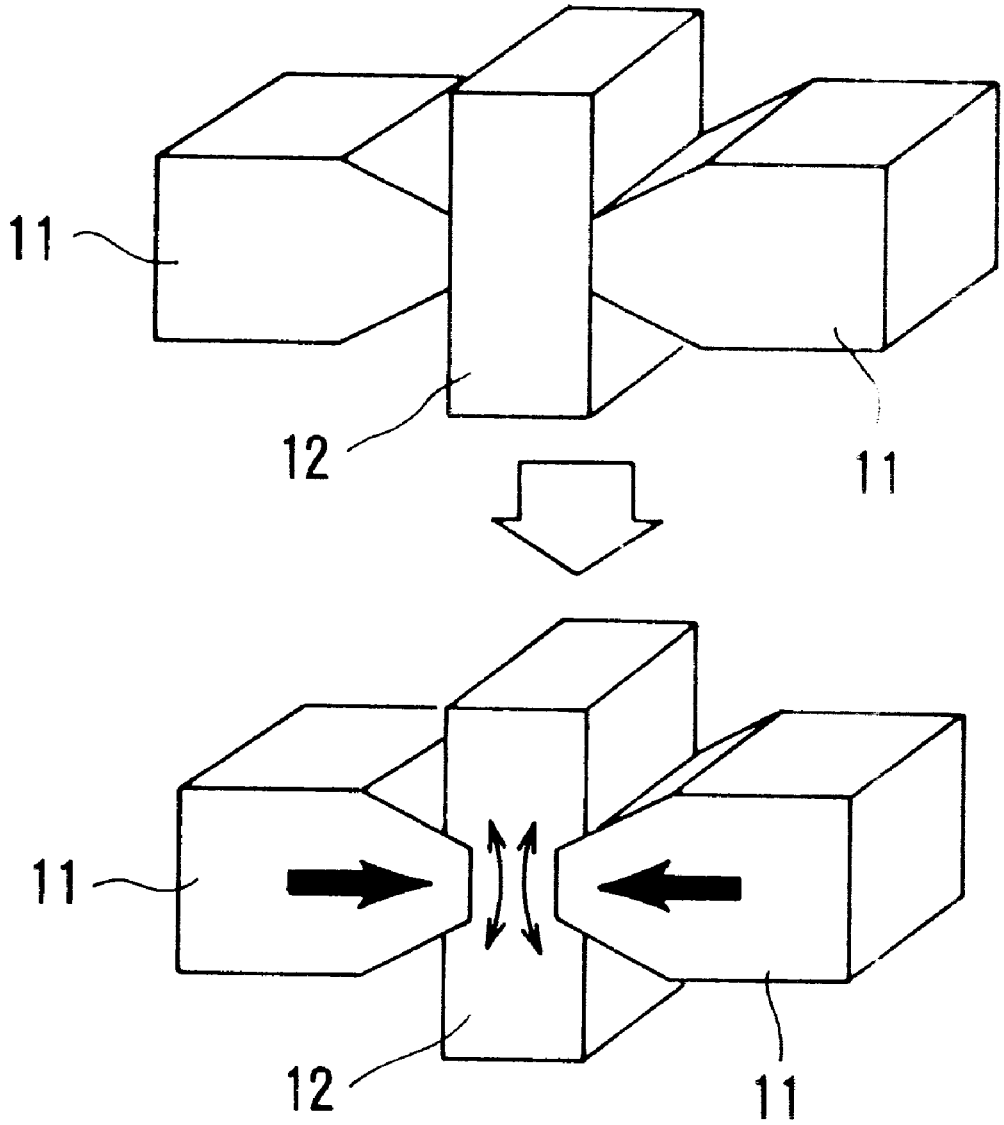
FIG. 3 is a brief view showing an anvil compressive process which is preferably applied to processing steps in a method for the manufacture of a high toughness and high strength steel of the invention of this application.

Although there are differences depending upon the composition of the steel, a process may be usually carried out at the temperature range from around 1,000° C. which is a temperature for producing austenite and to around 650° C. Anvil compressing deformation, rolling deformation, etc. may be appropriately selected and used with regard to a process. Among them, an anvil compressing deformation using anvils (11) as shown in FIG. 3 is one of the preferred examples. (12) in FIG. 3 shows steel pieces.

The reason why the temperature region for applying the process is made lower than the temperature for recrystallization of austenite as mentioned above is to avoid the disappearance of the deformed austenite grain boundary as a result of occurrence of recrystallization of austenite after the deformation.

The deformed amount at that time is to be made not less than 30% of total area reduction rate as a whole so that the above-mentioned transformation is introduced by a shear deformation. Preferably, it is 40–50%. During the deformation, it is preferred to make the strain rate not less than 10/second.

ii) Cooling which Results in Neither Recrystallization Nor Phase Transformation of a Diffused Type After the above deformation, cooling (3) is carried out until around the room temperature as shown in FIG. 2 under such a condition that neither recrystallization nor phase transformation of a diffused type takes place. This is because any of recrystallization and phase transformation of a diffused type makes the deformed austenite grain boundary disappeared. One of the conditions for the cooling is a cooling speed. The cooling speed is controlled to such an extent that neither recrystallization nor transformation of a diffused type takes place and is carried out until around room temperature. There is no particular limitation for the cooling method and any of the methods such as cooling with water, blowing with gas, etc. may be appropriately selected.

As compared with the conventional high strength steel having the same composition and nearly the same strength, a ductile-brittle transition temperature of the steel manufactured as such is lower than 15° C. or more. Thus, it is a high strength steel having an excellent toughness as well or, in other words, it is a high toughness and high strength steel.

The ductile-brittle transition temperature is one of the yardsticks for evaluating the toughness of a material. Even in the material causing a brittle fracture, the toughness is improved as the temperature rises and, at higher temperature than a curtain temperature region, there is a temperature region where the brittle fracture no longer takes place. Said boundary temperature is called a ductile-brittle transition temperature and, when said temperature is lower, such a material hardly affords a brittle fracture even at lower temperature or, in other words, it is a material having a high toughness.

As a means for improving the toughness, removal of impurities which deteriorate the prior-austenite grain boundary, addition of alloy metals, suppression of strength by tempering at high temperature, etc. have been known already. However, it is quite epoch-making in the invention of this application where no composition is changed and no additional step is added but mere thermo-mechanical processing improve the toughness without deterioration of the strength.

In addition, when the fact that, in bainite steel or the like, degree of improvement of 30° C. in the transition temperature of a product when tempering temperature is raised from 600° C., to 650° C. and strength is lowered from 1,000 MPa to 750 MPa is taken into consideration, the above-mentioned degree of improvement of 15° C. or even more without deterioration of strength is significantly big.

Incidentally, in the above-mentioned high toughness and high strength steel, it is preferred that its chemical composition is in such a state that the texture after deformation and cooling is to be martensite if at all possible. The chemical composition therefor may be appropriately selected from a broad range. Representative chemical composition in terms of % by weight including the range where carbon is relatively small will be as follows.

C: 0.10–0.80

Si: not more than 0.80

Mn: 0.80–3.0

Fe and unavoidable impurities: remainder

Compositions where at least one of not more than 0.10% by weight of Al, not more than 0.06% by weight of Nb and not more than 0.005% by weight of B are added thereto may be exemplified as well. Nb and B is effective as an element which suppresses the recrystallization. Other examples for the composition are Cr, Ni, Ti, P, O, etc.

Tempered Highly Toughness Martensite Steel and Its Manufacturing Method

In the conventional and common tempered martensite steel, filmy carbides are continuously precipitated in the prior-austenite grain boundary.

Figure 4:
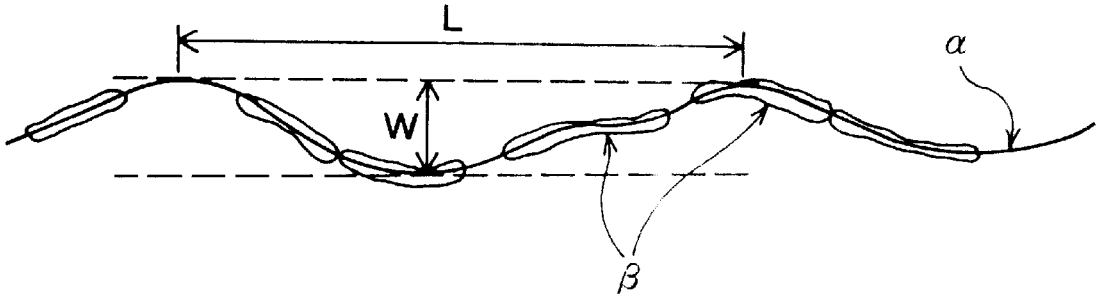
FIG. 4 is a brief view in a schematic manner of a grain boundary corresponding to the prior-austenite grain boundary of the tempered high toughness martensite steel in accordance with the invention of this application.

However, as shown in FIG. 4, in the tempered high toughness martensite steel of the invention of this application, the region where carbides (β) are present is restricted in the prior-austenite grain boundary (α) observed in a linear manner when seen from a vertical plane and the length is not larger than 80% of the total length of the prior-austenite grain boundary (α). As such, in the tempered high toughness martensite steel of the invention of this application, carbides in the prior-austenite grain boundary are restricted whereby the area where filmy carbide does not present in the prior-austenite grain boundary is formed. As a result, restriction of plastic strain near the prior-austenite grain boundary is released whereby the grain boundary fracture hardly takes place. When the length of the carbidess (β) is more than 80% of the total length of the prior-austenite grain boundary (α) observed in a linear manner when seen from a vertical plane, it is difficult to release the restriction of a plastic stain. Preferably, the existing rate of the carbides (β) is 70% or less.

In addition, the tempered high toughness martensite steel of the invention of this application also has a fine wavy ups and downs (which are characteristic in the above-mentioned high toughness and high strength steel) in the prior-austenite grain boundary. Like in the case of the high toughness and high strength steel, said ups and downs cause a geometric disturbance against a brittle fracture developing the prior-austenite grain boundary and, on the other hand, they also have a role that they produce nuclei of carbide the variant of which is different from each other on the grain boundary and make into granules without aggregation and growth of the separated carbides. For granulation of the carbides, it is necessary that, on the prior-austenite grain boundary which forms ups and down in fine waves when seen from a vertical plane, the variant among the carbides which grow as nuclei near there is different to more than a certain extent. The condition therefor is regulated to be that the cycle (L) is not more than 5 μm and the amplitude (W) is not less than 200 nm with a presumption that the carbides are separated out in adjacent locations with a space of not more than 500 nm on the prior-austenite grain boundary having around several μm at the smallest. Such a condition for ups and downs is in fact identical with that in the case of the above-mentioned high toughness and high strength steel. When any of the case where the cycle (L) is more than 5 μm and the amplitude (W) is less than 200 nm, then granulation of the carbides and prevention of the brittle fracture cannot be expected.

The tempered high toughness martensite steel of the invention of this application having such a characteristic prior austenite grain boundary is manufactured as follows. Thus, steel in a state of austenite is subjected to a deformation to not less than 30% of total area reduction rate at the temperature region which is lower than the temperature for recrystallization of austenite, then it is cooled to make the texture into martensite, heated at the temperature range of 300–500° C. with a heating rate of not less than 100° C./second, kept at said temperature for 10–30 seconds and cooled rapidly.

The technical elements which are characteristic to this manufacturing method are the following three points. Thus, they are i) deformation at an austenite region; ii) making into martensite; and iii) tempering.

i) Deformation at an Austenite Region

Figure 5:
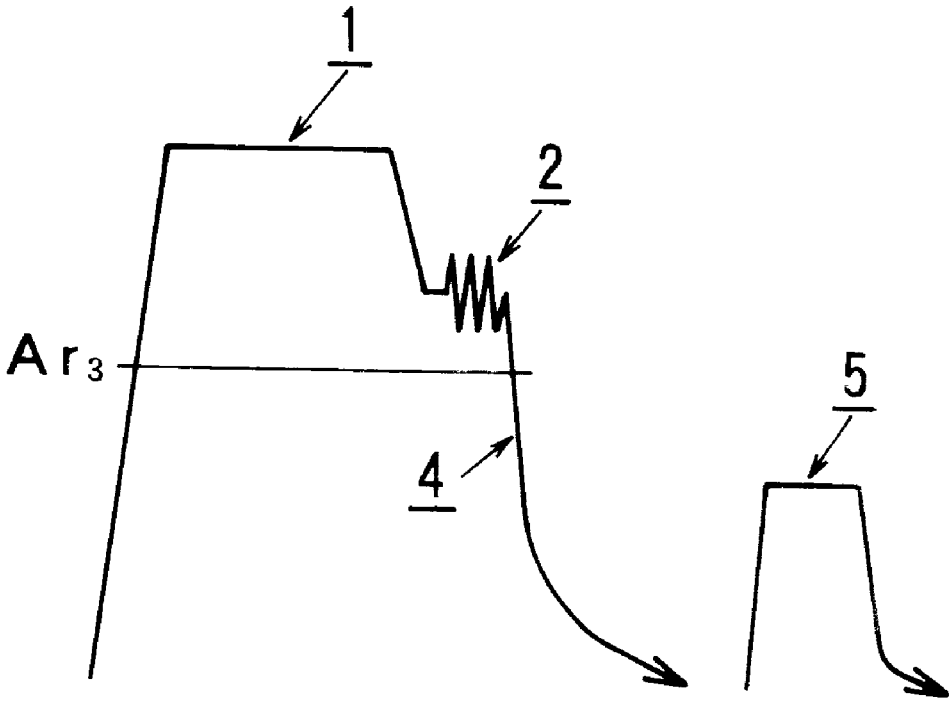
FIG. 5 is a process chart which briefly shows a method for the manufacture of the tempered high toughness martensite steel in accordance with the invention of this application.

As shown in FIG. 5, after the steel is completely made into austenite (1), a deformation (2) of resulting in not less than 30% of the total area reduction rate is carried out at the temperature region lower than the temperature for recrystallization of austenite. As a result of this deformation, a shear slip which is homogeneous macroscopically but non-homogeneous microscopically is resulted in the austenite crystal grains and the above-mentioned fine wavy ups and downs are introduced into the austenite grain boundary. When the temperature for the deformation is made lower than the temperature for recrystallization of austenite, it is possible to avoid the disappearance of the deformed austenite grain boundary due to the occurrence of recrystallization of austenite after the deformation.

In conducting the deformation, any of anvil compressing deformation, rolling process, etc. may be appropriately selected and adopted. Among the above, an anvil compressing process as exemplified in FIG. 3 is most preferred.

The deformed amount at that time is to be made not less than 30% of the total area reduction rate as a whole so that the above-mentioned deformation is introduced by a shear slip. Preferably, it is 40–50%. During the deformation, it is preferred to make the strain rate not less than 10/second.

ii) Making into martensite

After the deformation, cooling (4) is carried out, as shown in FIG. 5, under such a condition that all textures are transformed into martensite. As a result of this process for making into martensite, it is now possible to avoid recrystallization and phase transformation of a diffused type which are the causes for making the prior-austenite grain boundary disappeared.

With regard to the conditions for cooling, one of them is a cooling speed. Thus, a cooling speed by which all textures are transformed to martensite may be selected.

iii) Tempering

After that, a tempering (5) is carried out at the predetermined condition as mentioned already. As a result of tempering, the tempered carbides precipitate in the prior-austenite grain boundary. Due to the fine wavy ups and downs formed in the prior-austenite grain boundary by the deformation, the carbides in an adjacent locations each other in the grain boundary do not become the same variant and their aggregation and growth giving films can be avoided whereupon granules are achieved. As a result thereof, a certain area where the carbide do not exist remains in the prior-austenite grain boundary.

The conditions for a tempering are heating to a temperature of 300–500° C. with a heating rate of not less than 100° C./second, keeping at said temperature for 10–30 seconds, and a quick cooling after that.

When the temperature rising rate during the, heating is slow, then the specific variant of carbides grow with a formation of nuclei prior to others on the prior-austenite grain boundary and become bigger being apt to cover the prior-austenite grain boundary. That results in a decrease in the toughness. Therefore, it is necessary that the heating rate is at least 100° C./second. Due to the same reason, the tempering temperature and tempering time are to be not higher than 500° C. and not longer than 30 seconds, respectively. On the other hand, when the tempering temperature is too low and the tempering time is too short, the toughness tends to be insufficient and, accordingly, their lowest limits are to be 300° C. and 10 seconds, respectively. A rapid cooling is effective for prevention of growth of the carbides to big size in the prior-austenite grain boundary. A preferred example of the cooling speed upon a rapid cooling is not less than 15 K/second.

As compared with the conventional high strength steel having the same composition and nearly the same strength, a ductilebrittle transition temperature of the steel manufactured as such is lower than 20° C. or even more. Thus, the product is a tempered high toughness martensite steel. It is a quite epoch-making fact that the toughness can be improved without changing the composition, without adding steps other than deformation and cooling and without decreasing the strength. Further, the degree of improvement in a ductile-brittle transition temperature to an extent of 20° C. can be evaluated to be considerably high.

Like in the case of the already-mentioned high toughness and high strength steel, there is no particular chemical composition in said tempered high toughness martensite steel. Examples of the representative chemical composition in terms of % by weight are C: 0.20–0.80 and Mn: 0.80–3.0 while the remainder consists of Fe and unavoidable impurities.

It is preferred that C is not less than 0.20% by weight so that the texture before tempering is completely transformed to martensite and the strength is secured. On the other hand, if it is more than the eutectic point, precipitation of the carbides in the prior-austenite grain boundary is hardly suppressed and, accordingly, it is preferred to be not more than 0.80% by weight.

It is preferred that Mn is to be not less than 0.80% by weight so that austenite is made stable, hardenability is made good and the texture is made into martensite with a practical cooling speed. However, when it is added too much, softening during the tempering is significant and, in addition, ductility lowers. Accordingly, it is preferred to be not more than 3.0% by weight.

The compositions where at least one of not more than 0.80% by weight of Si and not more than 0.10% by weight of Al is added to the above chemical composition may be exemplified as well.

When more than 0.80% by weight of Si is added, it is unevenly distributed near the prior-austenite grain boundary and makes the texture hard and, as a result, deformation is disturbed and toughness lowers. Therefore, it is preferred to be not more than 0.80% by weight.

With regard to Al, it is preferred to add not more than 0.10% by weight for prevention of deterioration of the clarity of the steel and also for prevention of a decrease in strength due to inclusions produced thereby which cause the fracture.

EXAMPLES

The invention of this application will be further illustrated by way of the following examples.

Example 1

Steel having a composition of Fe, 0.35% of C, 1.5% of Mn and 0.5% of Si in terms of % by weight was made into martensite by the process consisting of the following steps of a–c.

a. heated by electricity at the rate of 5° C./second up to 1,100° C.;

b. kept at 1,100° C. for 60 seconds;

c. cooled down to 700° C. at the rate of 10° C./second;

d. subjected to an anvil compressing to 50% at 10/second; and e. cooled with water.

As shown in FIG. 6, in the resulting steel, the areas of not less than 90% of the prior-austenite grain boundary seen from a vertical plane had fine wavy ups and downs. Each cycle and amplitude of said ups and downs were not more than 2 $\mu$m and not less than 400 nm, respectively.

Incidentally, the prior-austenite grain boundary is the area as shown by an arrow in FIG. 6.

Tensile strength of the resulting steel was 1,397 MPa while ductile-brittle transition temperature thereof was 0° C.

Comparative Example 1

For comparison, the same steel as in Example 1 was not subjected to an anvil compressing process but was manufactured by the process consisting of the following steps a–d.

a. heated by electricity at the rate of 5° C./second up to 1,100° C.;

b. kept at 1,100° C. for 60 seconds;

C. cooled down to 750° C., at the rate of 10° C./second; and d. cooled with water.

As shown in FIG. 7, the prior-austenite grain boundary (indicated with an arrow in FIG. 7) in the resulting steel seen from a vertical plane is linear. Tensile strength of this steel was 1,315 MPa and ductile-brittle transition temperature thereof was +20° C.

It is apparent by comparing Example 1 with Comparative Example 1 that the high toughness and high strength steel in accordance with the invention of this application had predetermined ups and downs in the prior-austenite grain boundary when seen from the vertical plane and that the toughness was improved.

Example 2

A tempered martensite steel having a composition of Fe, 0.35% of C and 2.0% of Mn in terms of % by weight was manufactured by 3 process consisting of the following steps a–h.

a. heated by electricity at the rate of 5° C./second up to 1,100° C.;

b. kept at 1,100 °C. for 60 seconds;

c. cooled down to 750° C. at the rate of 10° C./second;

d. subjected to an anvil compressing to 50% at 10/second;

e. cooled with water;

f. subjected to an induction heating at the rate of 200° C./second up to 450° C.;

g. kept at 450° C. for 15 seconds; and h. cooled at the rate of about 50° C./second by blowing with He.

As shown in FIG. 8, in the resulting steel, prior-austenite grain boundary and its triple point which are noted in the conventional tempered martensite steel were not confirmed.

Further, as shown in FIG. 9, the prior-austenite grain boundary had fine wavy ups and downs when seen from a vertical plane. Each cycle and amplitude of said ups and downs were not more than 2 $\mu$m and not less than 400 nm, respectively. As shown in FIG. 9 with arrows, the areas where no carbides were present in the prior-austenite grain boundary were confirmed. Filmy carbides precipitated in the prior-austenite grain boundary were not more than 75% of the total length of the grain boundary seen from the vertical plane.

The fact that they were carbides was confirmed by means of an electron beam diffraction. It was also confirmed by means of an EPMA that the cabides were composed of Fe and C.

Tensile strength of this steel was 1,423 MPa and ductile-brittle transition temperature thereof was +30° C.

Comparative Example 2

For the sake of comparison, the steel having the same composition as in Example 2 was manufactured by the process consisting of the following steps a–g without an anvil compressing process.

a. heated by electricity at the rate of 5° C./second up to 1,100° C.;

b. kept at 1,100° C. for 60 seconds;

c. cooled down to 750° C., at the rate of 10° C./second;

d. cooled with water;

e. subjected to an induction heating at the rate of 200° C./second up to 450° C.;

f kept at 450° C. for 15 seconds; and g. cooled at the rate of about 50° C./second by blowing with He, As shown in FIG. 10, in the resulting steel, prior-austenile grain boundary and its triple point (the areas shown by arrows in FIG. 10) which are noted in the conventional tempered martensite steel were confirmed.

Further, as shown in FIG. 11, the prior-austenite grain boundary seen from a vertical plane was linear.

Tensile strength and ductile-brittle transition temperature of this steel were 1,354 MPa and +5° C., respectively.

It is apparent by comparing Example 2 with Comparative Example 2 that the tempered high toughness martensite steel in accordance with the invention of this application had the areas where no carbide was present in the prior-austenite grain boundary and, in addition, there were predetermined ups and downs in the prior austenite grain boundary when seen from the vertical plane and accordingly that the toughness was improved.

It goes without saying that the invention of this application is not limited by the above examples and that various particular embodiments are possible.

What is claimed is:

1. A high toughness and high strength steel comprising

C: 0.10–0.80

Si: not more than 0.80 and

Mn: 0.80–3.0 in terms of % by weight, and the remainder comprises Fe and unavoidable impurities, wherein the steel has a structure in which a part of not less than 70% per unit length of the prior-austenite grain boundary observed as a linear state when seen from a vertical plane has ups and downs with a cycle of not more than 5 $\mu$m and an amplitude of not less than 200 nm.

2. A tempered high toughness martensite steel comprising

C: 0.20–0.80 and

Mn: 0.80–3.00 in terms of % by weight, and the remainder comprises Fe and unavoidable impurities, wherein the steel has a structure in which length of a part where the carbides exist therein is not more than 80% of total length of a prior-austenite grain boundary observed in a linear state seen from a vertical plane, and said prior-austenite grain boundary has ups and downs with a cycle of not more than 5 $\mu$m and an amplitude of not less than 200 nm.

* * * * *